US008922179B2

(12) United States Patent
Kadanka

(10) Patent No.: US 8,922,179 B2
(45) Date of Patent: Dec. 30, 2014

(54) ADAPTIVE BIAS FOR LOW POWER LOW DROPOUT VOLTAGE REGULATORS

(75) Inventor: Petr Kadanka, Valasska Bystrice (CZ)

(73) Assignee: Semiconductor Components Industries, LLC, Phoenix, AZ (US)

( * ) Notice: Subject to any disclaimer, the term of this patent is extended or adjusted under 35 U.S.C. 154(b) by 496 days.

(21) Appl. No.: 13/323,082

(22) Filed: Dec. 12, 2011

(65) Prior Publication Data

US 2013/0147448 A1 Jun. 13, 2013

(51) Int. Cl.
*G05F 1/00* (2006.01)

(52) U.S. Cl.
USPC ..... 323/280; 323/274; 323/316

(58) Field of Classification Search
USPC ..... 323/273, 274, 280, 315, 316, 317; 327/540–546; 330/253, 261
See application file for complete search history.

(56) References Cited

U.S. PATENT DOCUMENTS

| | | | | |
|---|---|---|---|---|
| 7,218,082 | B2 * | 5/2007 | Walter et al. | 323/273 |
| 7,323,853 | B2 * | 1/2008 | Tang et al. | 323/280 |
| 7,521,909 | B2 * | 4/2009 | Dow et al. | 323/280 |
| 7,554,312 | B2 * | 6/2009 | Fulton et al. | 323/315 |
| 7,557,550 | B2 * | 7/2009 | Mellachurvu et al. | 323/281 |
| 7,843,180 | B1 * | 11/2010 | Cilingiroglu | 323/274 |
| 8,198,877 | B2 * | 6/2012 | Kuan et al. | 323/280 |
| 8,232,783 | B2 * | 7/2012 | Yanagawa | 323/277 |
| 8,299,774 | B2 * | 10/2012 | Wadhwa | 323/314 |
| 8,570,013 | B2 * | 10/2013 | Lipcsei et al. | 323/282 |
| 2008/0174289 | A1 * | 7/2008 | Gurcan et al. | 323/280 |
| 2009/0224737 | A1 * | 9/2009 | Lou | 323/280 |
| 2009/0315526 | A1 * | 12/2009 | Do Couto et al. | 323/275 |
| 2010/0148735 | A1 | 6/2010 | Napravnik | |
| 2011/0156686 | A1 | 6/2011 | Gakhar et al. | |

* cited by examiner

*Primary Examiner* — Jue Zhang
*Assistant Examiner* — Lakaisha Jackson
(74) *Attorney, Agent, or Firm* — Polansky & Associates, P.L.L.C.; Paul J. Polansky

(57) ABSTRACT

A low dropout (LDO) voltage regulator includes a voltage regulation loop for providing a gate drive signal to an output device, the gate drive signal proportional to an output current. The voltage regulation loop includes a current bias input for receiving a bias current. The LDO voltage regulator further includes a current bias control circuit for providing the adaptive bias current at a first value that is proportional to current limit value lab and the width-to-length ratio of transistors of the transconductance amplifier when the output current less than or equal to a threshold and increases the bias current from a threshold to a current limit value. The output current varies substantially linearly over a range of output current values between the threshold and the current limit value.

20 Claims, 2 Drawing Sheets

ADAPTIVE BIAS FOR LOW POWER LOW DROPOUT VOLTAGE REGULATORS

FIELD

This disclosure relates generally to low power low dropout (LDO) voltage regulators.

BACKGROUND

A low dropout (LDO) regulator is a direct current (DC) linear voltage regulator that can operate with a very small input-output differential voltage. Typically, the LDO regulator compares a voltage at the output to a reference voltage and controls a gate drive signal coupled to a power field effect transistor (FET) to maintain a substantially constant output voltage at the current electrode of the power FET.

In one instance, a bias current within the LDO regulator can be adjusted by switching additional bias current into the amplifier when a threshold output current is reached. However, such abrupt switching can introduce an output voltage glitch that is visible when the output current is changing slowly due to the switch-induced change in the bias current.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

An embodiment of an LDO regulator circuit is described below that includes a transconductance amplifier to provide adaptive bias that proportionally controls an amplifier and a driver stages with no discontinuous or switch modes. The transconductance amplifier includes two transistors and a common mode current source that provides a current limit (Iab). The inputs of the transconductance amplifier are biased by two identical branches and the output current of the transconductance amplifier is given by a dimensions ratio of the transistors within a range of output currents. The output current of the transconductance amplifier is mirrored by a current mirror to create an adaptive bias current for the output stage of the LDO regulator. The adaptive bias current is limited to a current limit ($I_{ab}$) for a high output current. The transition between the adaptive bias current for a low value of the output current and the adaptive bias current for high value of the output current is provided by the transconductance of the transconductance amplifier. An exemplary embodiment of the circuit is described below with respect to FIG. 1.

Figure 1:
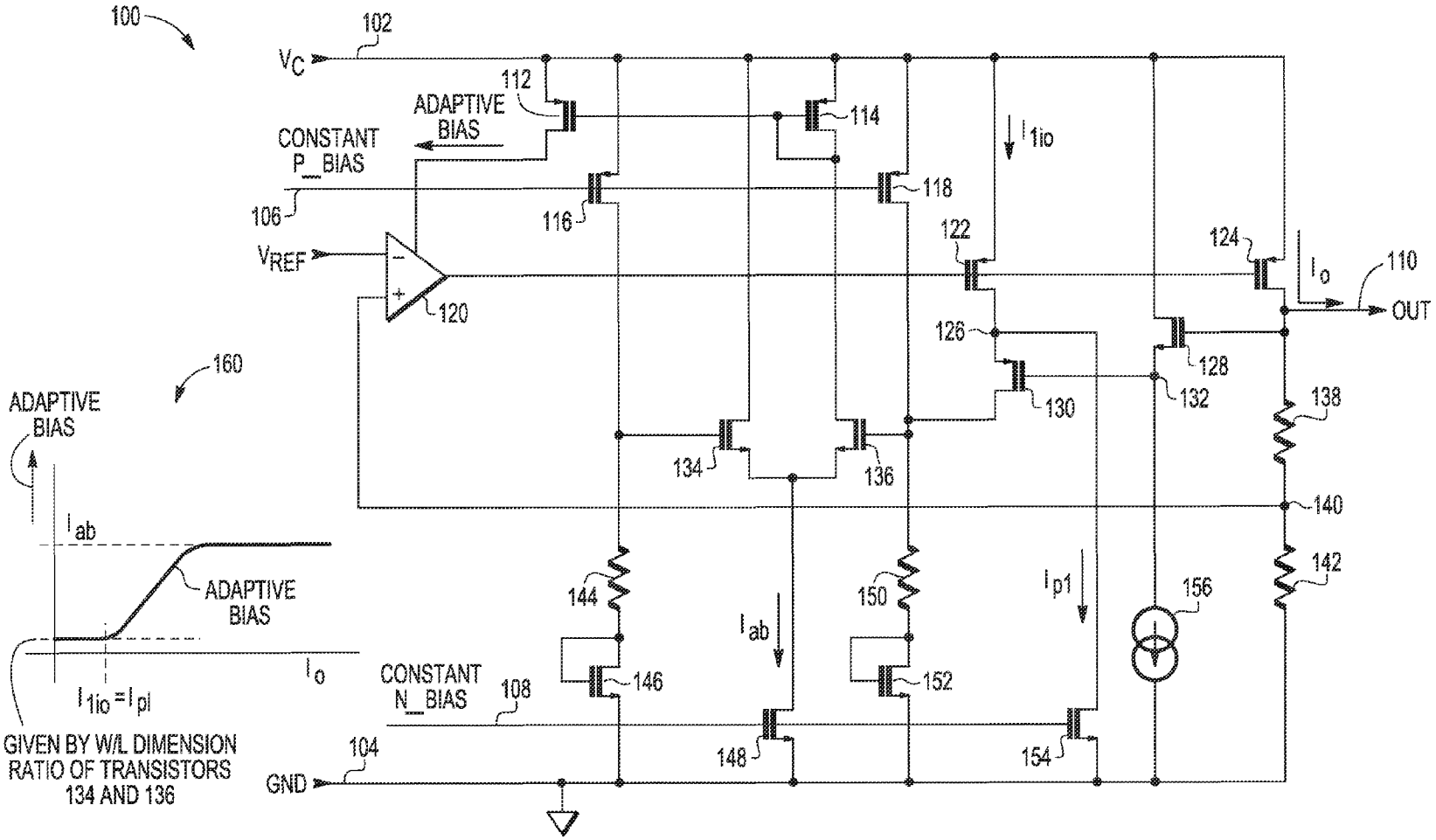
FIG. 1 is diagram of an embodiment of an LDO regulator circuit including a circuit for providing an adaptive bias with no discontinuities or switch modes.

FIG. 1 is diagram of an embodiment of a low dropout (LDO) regulator circuit 100 including a circuit for providing an adaptive bias. LDO regulator circuit 100 includes a power supply terminal 102 connected to a first voltage (Vc) and a power supply terminal 104 connected to ground. LDO regulator circuit 100 further includes a bias terminal 106 for providing a constant bias current (Constant P_bias) for biasing P-channel transistors and a bias terminal 108 for providing a constant bias current (Constant N_bias) for biasing N-channel transistors.

LDO regulator circuit 100 includes a current mirror including transistor 112 and transistor 114. Transistor 112 including a source connected to power supply terminal 102, a gate connected to a gate of transistor 114, and a drain. The drain of transistor 112 provides a first current flow path. Transistor 114 includes a source connected to the power supply terminal and a drain. The drain of transistor 114 provides a second current flow path. Transistor 112 is configured to generate a current proportional to a current flowing through transistor 114.

LDO regulator circuit 100 further includes another current source circuit including matched transistors 116 and 118. Transistor 116 includes a source connected to power supply terminal 102, a gate connected to bias terminal 106, and a drain. Transistor 118 includes a source connected to power supply terminal 102, a gate connected to bias terminal 106, and a drain.

LDO regulator circuit 100 also includes an amplifier 120 having a first input for receiving a reference voltage ($V_{REF}$), a second input connected to a node 140, and an output connected to gates of transistors 122 and 124 forming matched current sources. Transistor 124 is a power metal oxide semiconductor field effect transistor (MOS) that includes a source connected to power supply terminal 102, a gate connected to the output of amplifier 120, and a drain connected to the output terminal 110. Transistor 122 includes a source connected to power supply terminal 102, a gate connected to the output of amplifier 120, and a drain connected to a node 126, which is connected to a source of a transistor 130, which has a gate connected to node 132, and a drain connected to the drain of transistor 118. LDO regulator circuit 100 further includes a transistor 128 including a drain connected to power supply terminal 102, a gate connected to output terminal 110, and source connected to node 132 and to a current source 156 having a first terminal connected to node 132 and a second terminal connected to power supply terminal 104.

LDO regulator 100 further includes a voltage divider circuit including resistors 138 and 142. Resistor 138 includes a first terminal connected to output terminal 110 and a second terminal connected to node 140. Resistor 142 includes a first terminal connected to node 140 and a second terminal connected to power supply terminal 104. Thus, node 140 provides a feedback voltage relative to current flowing through transistor 124 and the resistances of resistors 138 and 142.

LDO regulator 100 includes a transistor 154 having a drain connected to node 126, a gate connected to bias terminal 108, and a source connected to power supply terminal 104. LDO regulator 100 also includes a resistor 144 having a first terminal connected to a drain of transistor 116, and a second terminal connected to a drain and gate of transistor 146. Transistor 146 is diode-connected and includes a source connected to power supply terminal 104. LDO regulator 100 further includes a resistor 150 having a first terminal connected to a drain of transistor 118, and a second terminal connected to a drain and gate of transistor 152. Transistor 152 is diode-connected and includes a source connected to power supply terminal 104. In this instance, the resistor 144 and transistor 146 are matched to resistor 150 and transistor 152. Further, currents flowing through resistors 144 and 150 produce bias voltages for biasing a transconductance amplifier including transistors 134 and 136.

Transistors 134 and 136 have a common mode current source provided by transistor 148. Transistor 134 includes a drain connected to power supply terminal 102, a gate connected to the drain of transistor 116, and a source connected to the source of transistor 136 and to a drain of transistor 148. Transistor 148 includes a gate connected to bias terminal 108 and a source connected to power supply terminal 104. Transistor 136 includes a drain connected to the drain of transistor 114, a gate connected to the drain of transistor 118 and the drain of transistor 130, and a source connected to the source of transistor 134 and the drain of transistor 148. In an example, current flowing between the drains of transistors 114 and 136 can be referred to as a bias control current.

In operation, transconductance amplifier (transistors 134 and 136) produces an adaptive bias current that proportionally controls current bias of amplifier 120 with no discontinuous or switch modes. Transconductance amplifier provided by transistors 134 and 136 includes a current source provided by transistor 148, which is biased by the constant N_bias on bias terminal 108 to provide a limiting current (Iab). Transistor 122 is configured as matched with transistor 124 and provides a current $I_{1io}$ that is proportional to the output current ($I_o$). The gates of transistor 134 and 136 are biased by identical branches including transistors 116 and 146 and resistor 144 for the gate of transistor 134 and including transistors 118 and 152 and resistor 150 for the gate of transistor 136. When the proportional current $I_{1io}$ is less than a current $I_{p1}$ through transistor 154, the gate of transistors 134 and 136 have identical voltage potentials, and the output current of the transconductance amplifier is given by the dimensional ratio (Width/Length) of transistors 134 and 136. In this instance, the output current of the transconductance amplifier on the drain of transistor 136 amplifier is not zero for low (zero) values of the output current ($I_o$).

When the output current Io starts to rise, the proportional current ($I_{1io}$) increases above the current $I_{P1}$ ($I_{1io}>I_{p1}$), causing additional voltage drop on transistor 152 and resistor 150 and increasing of the output current on the drain of transistor 136. In other words, the adaptive bias current for low output currents is given by the value of limiting current (Iab) and the width-to-length ratio of transistors 134 and 136. The output current of the transconductance amplifier on the drain of transistor 136 is mirrored by the current mirror provided by transistors 114 and 112 to produce a proportional current that serves as the adaptive bias current applied to a terminal of amplifier 120. The adaptive bias current is limited to the value of the limiting current (Iab) for high values of the output current ($I_o$). Further, the transition between the adaptive bias current at low values of the output current (Io) is given by the dimensions of the transistors 134 and 136, thereby providing a bias current that transitions without switching and with no discontinuities.

As shown in the graph 160 to the left of LDO regulator 100, the adaptive bias current is given by the current Iab and the width-to-length ratio of transistors 134,136 until the output current rises such that the proportional current ($I_{1io}$) exceeds $I_{P1}$. When the proportional current ($I_{1io}$) exceeds the current $I_{P1}$, the adaptive bias current increases in a substantially linear fashion (i.e., has a substantially linearly increasing slope) until the bias current reaches the current limit set by current (Jab) through transistor 148.

In operation, the LDO regulator 100 provides a low quiescent current (a non-zero current) when the output current is approximately zero, as the bias current is limited to the current Iab and the width-to-length ratio of transistors 134 and 136. However, despite the low quiescent current (ground current at Io=0), LDO regulator 100 provides an excellent dynamic power supply rejection ration and noise performance at higher output currents. In particular, the bias current is driven by the output current and is very low at low output currents and increases substantially linearly as the output current ($I_o$) increases until the current limit (Iab) is reached.

In an example, amplifier 120, resistors 138 and 142, and node 140 are part of a voltage regulation loop for providing a gate drive signal to an output device, such as transistor 124, that is proportional to reference voltage ($V_{REF}$). The voltage regulation loop includes a current bias input that is formed by the drain of transistor 112 for receiving the bias current (Adaptive Bias current). In this example, transconductance amplifier (transistors 134 and 136), current source (transistor 148), transistors 112, 114, 122, 130, 146, and 152, and resistors 144 and 150 form a current bias control circuit. The transconductance amplifier (transistors 134 and 136) and transistor 152 cooperate to provide the bias current at a first value that is proportional to a width-to-length ratio of transistors 134 and 136 and a current through transistor 152, and increases the bias current up to a current limit value that is set by the current (Jab) flowing through transistor 148. The adaptive bias current varies substantially linearly over a range of output current values between the threshold and the current limit value. Transistors 122 and 130 can be referred to as a current injection circuit, in part, because they operate to inject a supplemental current onto resistor 150, supplementing the voltage at the gate of transistor 136.

In an alternative embodiment, transistor 154 may include an array of transistors configured in parallel and adapted to provide a weighted selection for adjusting the current ($I_{P1}$) as a function of the weighted selection. By utilizing an array of transistors, the low bias current threshold can be selectively adjusted to provide a desired quiescent current level. An example of bias current values for one possible implementation of the LDO regulator circuit 100 is described below with respect to FIG. 2.

Figure 2:
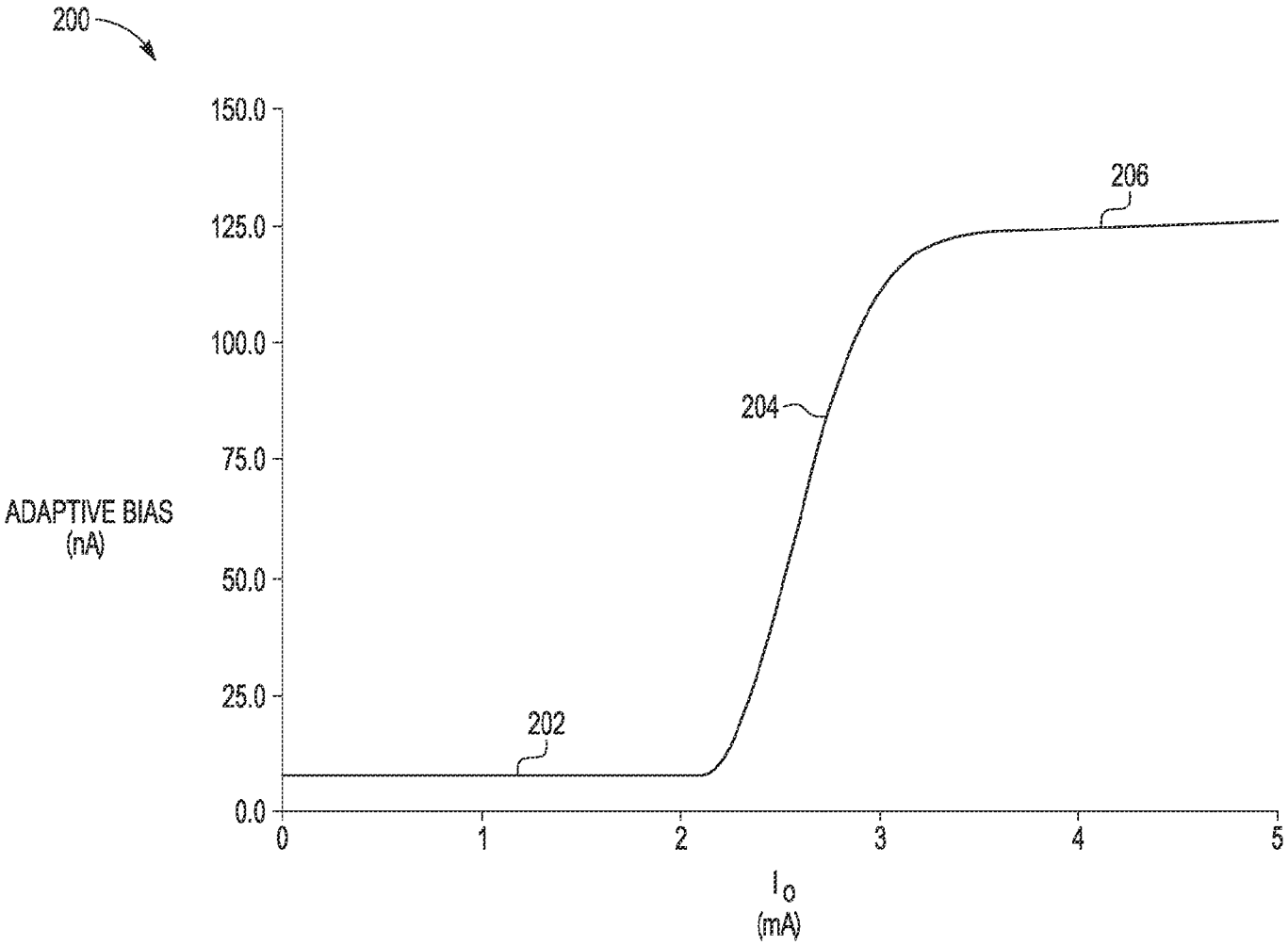
FIG. 2 is a graph of the adaptive bias current in nanoamperes as a function of the output current of the LDO regulator circuit of FIG. 1.

FIG. 2 is a graph 200 of an example of the adaptive bias current in nanoamperes (nA) as a function of the output current of the LDO regulator circuit of FIG. 1. In this instance, the current $I_{P1}$ is set to approximately seven (7) nA. At 202, over a range of output current values from approximately zero Amperes (A) to approximately 2.2 mA, the bias current is given by the current Iab and the width-to-length ratio of transistors 134 and 136. When the output current exceeds 2.2 mA, the bias current increases substantially linearly (as indicated at 204) from the current level given by the value of the current Iab and the width-to-length ratio of transistors 134 and 136 up to a current limit set by the current Iab, which in this instance is approximately 125 nA (generally indicated at 206). Once the bias current reaches the current limit Iab, the bias current plateaus, providing a stable bias current for amplifier 120.

In an example, transistors 134 and 136 cooperate with the current mirror (transistors 112 and 114) to provide an adaptive bias current to the current bias input of amplifier 120. When a proportional current ($I_{1io}$) that is proportional to the output current ($I_o$) is less than a threshold (set by current ($I_{P1}$) flowing through transistor 154), the first value of the adaptive bias current is given by the Iab and the width-to-length ratio of transistors 134 and 136. When the proportional current ($I_{1io}$) exceeds the threshold Ip1, the adaptive bias current increases substantially linearly over a range of output current values between the threshold and a current limit value Iab. The linearity of the adaptive bias current is determined by the geometries of transistors 134 and 136.

Thus, as previously discussed, by utilizing the transconductance of the transistors 134 and 136, the adaptive bias current is adjusted linearly according to their respective geometries and without discontinuities that might otherwise exist if the bias current were switched. Thus, at low values, the adaptive bias current is given by the value of current Iab and the width-to-length ratio of transistors 134 and 136. When the output current reaches a level such that proportional current $I_{1io}$ is greater than the current $I_{P1}$, the bias current is set by the geometries of transistors 134 and 136. When the adaptive bias current reaches a current level of limit current (Iab), the bias current is set by the current limit Iab.

In conjunction with the circuit described above, an LDO regulator includes an amplifier configured to control a gate of a power transistor. The LDO regulator includes a transconductance amplifier that provides a current that is mirrored to produce a proportional bias current to bias that amplifier. The bias current is at a first level when the output current is below a first threshold, is at a current limit level when the bias current reaches the current limit, and varies substantially linearly therebetween.

Although the present invention has been described with reference to preferred embodiments, workers skilled in the art will recognize that changes may be made in form and detail without departing from the scope of the invention.

What is claimed is:

1. A low dropout (LDO) voltage regulator comprising:

a voltage regulation loop for providing a gate drive signal to an output device, the gate drive signal proportional to an output current, the voltage regulation loop including a current bias input for receiving an adaptive bias current; and a current bias control circuit for providing the adaptive bias current at a first value that is proportional to a width-to-length ratio of transistors of a transconductance amplifier and a current applied to a first input of the transconductance amplifier, the current bias control circuit increases the adaptive bias current from a threshold to a current limit value, the output current varies substantially linearly over a range of output current values between the threshold and the current limit value.

2. The LDO voltage regulator of claim 1, wherein the current bias control circuit comprises:

a current mirror including a first current flow path coupled to the current bias input, and a second current flow path; and the transconductance amplifier including the first input for receiving a first voltage related to the current, a second input for receiving a second voltage, and an output coupled to the second current flow path for providing a bias control signal.

3. The LDO voltage regulator of claim 2, wherein the transconductance amplifier comprises:

a first transistor including a drain coupled to a power supply terminal, a gate, and a source; and a second transistor including a drain coupled to the second current flow path of the current mirror, a gate, and a source coupled to the source of the first transistor.

4. The LDO voltage regulator of claim 3, further comprising:

a third transistor including a drain coupled to the sources of the first and second transistors, a gate for receiving a bias voltage, and a source coupled to the power supply terminal; and wherein a second current flowing through the third transistor forms the current limit value.

5. The LDO voltage regulator of claim 1, further comprising:

a first transistor including a source coupled to a power supply terminal, a gate coupled to the output of the transconductance amplifier, and a drain;

a second transistor including a source coupled to the drain of the first transistor, a gate, and a drain coupled to the current bias control circuit; and a third transistor including a drain coupled to the drain of the first transistor, a gate for receiving a bias voltage, and a source coupled to a second power supply terminal; and wherein a current flowing through the third transistor sets the threshold.

6. The LDO voltage regulator of claim 5, further comprising:

a current mirror including a first current flow path coupled to the current bias input, and a second current flow path;

wherein the first input of the transconductance amplifier receives a first voltage and the transconductance amplifier also includes a second input for receiving a second voltage, and an output coupled to the second current flow path for providing a bias control signal;

a first bias circuit configured to provide the first voltage to the first input, the first voltage being substantially constant;

a second bias circuit configured to provide the second voltage to the second input; and a current injection circuit coupled to the second input and configured to provide a supplemental bias voltage to the second input, the supplemental bias voltage related to the output current.

7. The LDO voltage regulator of claim 1, wherein the voltage regulation loop comprises an amplifier including a first input for receiving a first reference voltage, a second input for receiving a feedback voltage, a control input for receiving the adaptive bias current, and an output for providing the gate drive signal.

8. The LDO voltage regulator of claim 1, wherein the current bias control circuit comprises a current mirror comprising:

a first transistor including a source coupled to a power supply terminal, a gate, and a drain coupled to the current bias input for providing the bias current; and a second transistor including a source coupled to the power supply terminal, a gate coupled to the gate of the first transistor, and a drain coupled to the gate of the first and second transistors, wherein the first input of the transconductance amplifier receives a reference voltage, and the transconductance amplifier also includes a second input that varies as a function of the output current, and an output coupled to the drain of the second transistor.

9. A low dropout (LDO) voltage regulator comprising:

an amplifier including a first input for receiving a reference voltage, a second input for receiving a feedback signal, a bias current input and an output for providing a gate drive signal;

a current mirror including a first current path and a second current path, the first current path coupled to the bias current input of the amplifier; and a transconductance amplifier including a first input for receiving a second reference voltage, a second input for receiving a voltage related to an output current, and an output coupled to the second current path of the current mirror for providing the output current as a function of a difference between the second reference voltage and the voltage related to the output current, the transconductance amplifier configured to control a current bias provided to the amplifier.

10. The LDO voltage regulator of claim 9, wherein the transconductance amplifier comprises:

a first transistor including a drain coupled to a power supply terminal, a source, and a gate forming the first input for receiving the second reference voltage; and a second transistor having a drain forming the output, a source coupled to the source of the first transistor, and a gate forming the second input for receiving the voltage related to the output current; and a third transistor including a drain coupled to the sources of the first and second transistors, a gate for receiving a first bias voltage, and a source coupled to ground.

11. The LDO voltage regulator of claim 10, wherein a current flowing through the third transistor defines a bias current limit.

12. The LDO voltage regulator of claim 9, further comprising:

a first bias circuit coupled to the first input of the transconductance amplifier for providing the second reference voltage;

a second bias circuit coupled to the second input of the transconductance amplifier, the second bias circuit matched to the first bias circuit to provide a third reference voltage to the second input that is equal to the second reference voltage; and a third bias circuit configured to provide a current proportional to the output current to the second input of the transconductance amplifier, the third bias circuit to provide a third voltage that combines with the third reference voltage to provide the voltage related to the output current.

13. The LDO voltage regulator of claim 12, wherein the first bias circuit comprises:

a first transistor including a source coupled to a power supply terminal, a gate for receiving a second bias voltage, and a drain coupled to the first input of the transconductance amplifier;

a first resistor including a first terminal coupled to the drain of the first transistor, and a second terminal, a second voltage across the resistor forming the second reference voltage; and a second transistor including a drain and a gate coupled to the second terminal of the first resistor, and a source coupled to ground.

14. The LDO voltage regulator of claim 13, wherein the second bias circuit comprises:

a third transistor including a source coupled to the power supply terminal, a gate for receiving the second bias voltage, and a drain coupled to the second input of the transconductance amplifier;

a second resistor including a first terminal coupled to the drain of the third transistor, and a second terminal, a third voltage across the resistor forming the third reference voltage; and a fourth transistor including a drain and a gate coupled to the second terminal of the second resistor, and a source coupled to ground.

15. The LDO voltage regulator of claim 14, wherein the third bias circuit comprises:

a fifth transistor configured to match the output current to produce a proportional current, the fifth transistor including a source coupled to the power supply terminal, a gate coupled to the output of the amplifier, and a drain;

a sixth transistor including a source coupled to the drain of the fifth transistor, a gate, and a drain coupled to the second input of the transconductance amplifier; and a seventh transistor including a drain coupled to the drain of the fifth transistor, a gate for receiving a first bias voltage, and a source coupled to ground; and an eighth transistor including a drain coupled to the power supply terminal, a gate coupled to an output terminal, and a source coupled to the gate of the sixth transistor and to ground through a current source.

16. A low dropout (LDO) voltage regulator comprising:

an amplifier including a first input for receiving a reference voltage, a second input for receiving a feedback voltage, a current bias input, and an output for providing a gate drive signal;

a power transistor including a first current electrode for receiving a supply voltage; a control electrode coupled to the output of the amplifier, and a second current electrode coupled to an output terminal for providing an output current; and an adaptive current bias circuit coupled to the current bias input and configured to provide an adaptive bias current having a first current level to the current bias input when the output current is less than a threshold, and, when the output current exceeds the threshold, increasing the adaptive bias current from the first current level along a substantially linear slope until a current limit is reached.

17. The LDO voltage regulator of claim 16, further comprising a voltage divider circuit including:

a first resistor including a first terminal coupled to output terminal, and a second terminal coupled to the second input of the amplifier to provide the feedback voltage; and a second resistor including a first terminal coupled to the second terminal of the first resistor, and a second terminal coupled to ground.

18. The LDO voltage regulator of claim 16, wherein the adaptive current bias circuit provides a non-zero current when the output current is zero.

19. The LDO voltage regulator of claim 16, wherein the adaptive current bias circuit comprises:

a current mirror including a first current flow path coupled to the current bias input, and a second current flow path, the current mirror to provide the adaptive bias current on the first current flow path that is proportional to a second current on the second current flow path; and a transconductance amplifier including a first input for receiving a second reference voltage, a second input for receiving a second voltage that is proportional to the output current, and an output coupled to the second current flow path, the transconductance amplifier configured to provide the adaptive bias current as a function of a voltage between the second reference voltage and the second voltage.

20. The LDO voltage regulator of claim 19, wherein the transconductance amplifier comprises:

a first transistor including a drain coupled to a power supply terminal, a gate for receiving the second reference voltage, and a source;

a second transistor including a drain coupled to the second current flow path, a gate for receiving the second voltage, and a source coupled to the source of the first transistor; and a third transistor including a drain coupled to the sources of the first and second transistors, a gate for receiving a bias voltage, and a source coupled to ground; and wherein current flowing through the third transistor sets the current limit.

* * * * *

UNITED STATES PATENT AND TRADEMARK OFFICE

CERTIFICATE OF CORRECTION

PATENT NO. : 8,922,179 B2
APPLICATION NO. : 13/323082
DATED : December 30, 2014
INVENTOR(S) : Petr Kadanka It is certified that error appears in the above-identified patent and that said Letters Patent is hereby corrected as shown below:

In the Specification:

In column 3, line 58, replace "(Jab)" with "(lab)".

In column 4, line 18, replace "(Jab)" with "(lab)".

Signed and Sealed this
Fifth Day of April, 2016

Michelle K. Lee

Michelle K. Lee
*Director of the United States Patent and Trademark Office*